US008726859B2

(12) United States Patent
Yuasa et al.

(10) Patent No.: US 8,726,859 B2
(45) Date of Patent: May 20, 2014

(54) TWO-STROKE CYCLE COMBUSTION ENGINE OF AIR SCAVENGING TYPE

(75) Inventors: Tsuneyoshi Yuasa, Kobe (JP); Tadao Yashirodai, Kakogawa (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 331 days.

(21) Appl. No.: 13/154,333

(22) Filed: Jun. 6, 2011

(65) Prior Publication Data

US 2011/0308507 A1 Dec. 22, 2011

(30) Foreign Application Priority Data

Jun. 22, 2010 (JP) ..... 2010-141276
May 23, 2011 (JP) ..... 2011-114499

(51) Int. Cl.
*F02B 25/00* (2006.01)

(52) U.S. Cl.
USPC .... 123/73 PP; 112/65 V; 112/585; 112/65 R; 112/195 R; 112/73 R

(58) Field of Classification Search
USPC ..... 123/73 PP, 65 V, 585, 65 R, 195 R, 73 R
See application file for complete search history.

(56) References Cited

U.S. PATENT DOCUMENTS 4,306,522 A * 12/1981 Fotsch ..... 123/73 R
6,662,766 B2 * 12/2003 Araki et al. ..... 123/73 PP
6,978,744 B2 12/2005 Yuasa et al.
7,089,891 B2 8/2006 Yuasa et al.
7,458,153 B2 * 12/2008 Uhl et al. ..... 29/888.06
7,520,253 B2 * 4/2009 Mochizuka et al. ..... 123/73 PP
8,459,217 B2 * 6/2013 Ogura et al. ..... 123/73 PP
2004/0244738 A1 12/2004 Yuasa et al.
2004/0255883 A1 12/2004 Yuasa et al.
2008/0098992 A1 5/2008 Mochizuka et al.
2009/0013982 A1 * 1/2009 Yuasa et al. ..... 123/65 R
2009/0095269 A1 * 4/2009 Zama ..... 123/73 A
2010/0288251 A1 * 11/2010 Ogura et al. ..... 123/65 P
2013/0291840 A1 * 11/2013 Ono et al. ..... 123/559.1

FOREIGN PATENT DOCUMENTS

CN 101029607 9/2007
JP 2004-360656 12/2004
JP 2008-111339 5/2008
JP 2008-138602 6/2008

OTHER PUBLICATIONS

Chinese Patent Application No. 201110161940.5 Office Action dated Mar. 5, 2013, 11 pages with partial English translation.
Chinese Patent Application No. 201110161940.5 Office Action dated Nov. 4, 2013, 8 pages with partial English translation.

* cited by examiner

*Primary Examiner* — Marguerite McMahon
*Assistant Examiner* — James Kim

(57) ABSTRACT

A two-stroke cycle combustion engine of an air scavenging type includes one or more scavenging passages (13, 14) for communicating a crank chamber (2*a*) and a combustion chamber (1*a*) with each other, an air passage (10) for supplying an air (A), an introducing passages (16) for introducing the air (A) from the air passage (10) into an upper portion of each scavenging passage (13, 14) from a direction radially outwardly of a cylinder block (1), and a covering member (21) for covering the introducing passage (16) from an outer side. The covering member (21), the upper portion of each scavenging passage (13, 14) and a part of the introducing passage (16) are formed integrally with each other by a scavenging block (20).

10 Claims, 11 Drawing Sheets

TWO-STROKE CYCLE COMBUSTION ENGINE OF AIR SCAVENGING TYPE

CROSS REFERENCE TO THE RELATED APPLICATION

This application is based on and claims Convention priority to Japanese patent application No. 2010-141276, filed Jun. 22, 2010 and Japanese patent application No. 2011-114499, filed May 23, 2011, the entire disclosure of which is herein incorporated by reference as a part of this application.

BACKGROUND OF THE INVENTION 1. (Field of the Invention)

The present invention relates to a two-stroke cycle combustion engine of an air scavenging type that is used as a drive source for a compact work machine such as, for example, a brush cutter.

2. (Description of the Related Art)

The two-stroke cycle combustion engine of an air scavenging type has been well known in the art, in which prior to the combustion chamber being scavenged with an air/fuel mixture, leading scavenging with air is performed to suppress an eventual blow-off of the air/fuel mixture from the exhaust port. The JP Laid-open Patent Publication No. 2004-360656, published Dec. 24, 2004, discloses this type of the combustion engine, in which a pair of first scavenging passage and a pair of second scavenging passages are provided inside a cylinder block and a crankcase so that an air introduced from the outside into an air passage can be once introduced into the second scavenging passages through an introducing passage and, during the scavenging stroke, the air from the second scavenging passages can be supplied into the combustion chamber prior to the supply of the air/fuel mixture from the first scavenging passages to thereby suppress the eventual blow-off of the air/fuel mixture from the exhaust passage. In this known combustion engine, the introducing passage communicating the air passage with the second scavenging passages is formed between a recess, defined in an outer peripheral portion of the cylinder block, and a plate-shaped lid for closing such recess.

The engine cylinder block manufactured by means of casting is apt to have casting burrs around openings such as, for example, an scavenging opening (a scavenging port) and cast mating sites. Such casting burrs are generally removed by means of a complicated and time consuming work of removing the burrs with a cutting tool such as, for example, a file having been inserted into the cylinder block through the recess defined in the cylinder blocks.

On the other hand, the JP Laid-open Patent Publication No. 2008-138602, published Jun. 19, 2008, discloses a different type of two-stroke cycle combustion engine, in which a space communicated with the air passage is defined between an inner surface of an opening, formed in the cylinder block, and an inner surface of a covering member capped into such opening and is divided by a partition segment, formed integrally with the covering, so as to communicate with a second scavenging port of a second scavenging passage for the supply of an air and in which a recess for reserving the air is formed at an outer periphery portion of the reciprocating piston so that such recess is communicated with the second scavenging port upon the ascending motion during the scavenging stroke. In this known combustion engine, since the partition segment for defining the wall surface of a passage for guiding the air towards the second scavenging port is formed integrally with the covering member, the first and second scavenging ports in the cylinder block in a condition before the covering member is fitted to such cylinder block are exposed to the outside through the opening and, therefore, the removal of the burrs in the cylinder block can be easily performed.

However, since the combustion engine disclosed in the above mentioned publication No. 2008-138602 is so designed that the air from the air passage is introduced from the second scavenging port into the second scavenging passage by way of the recess in the outer periphery of the reciprocating piston, the cost of manufacture becomes high as a result of complication in structure. Also, since the amount of the air introduced into the second scavenging passage is determined depending on the shape of the recess in the reciprocating piston which is a relatively large casting, setting and adjustment of the amount of the air so introduced cannot be accomplished easily.

SUMMARY OF THE INVENTION

In view of the foregoing, the present invention has for its object to provide a two-stroke cycle combustion engine of an air scavenging type, in which while such engine has an inexpensive and simplified structure, removal of the burrs in the cylinder block and adjustment of the amount of the air can be easily performed.

In order to accomplish the foregoing object, the present invention provides a two-stroke cycle combustion engine of an air scavenging type which includes one or more scavenging passages for communicating a crank chamber and a combustion chamber, an air passage for supplying an air, an introducing passage for intruding the air from the air passage into an upper portion of each scavenging passage from a direction radially outwardly of a cylinder block, a covering member for covering the introducing passage from an outer side, and a scavenging block forming the upper portion of each scavenging passage and a part of the introducing passage between the scavenging block and the covering member.

According to this construction, since the scavenging block is formed with the upper portion of the scavenging passage and the part of the introducing passage, the scavenging port in the cylinder block in a condition before the scavenging block is fitted to such cylinder block is exposed to the outside through an opening of a large open area into which the scavenging block is inserted and, accordingly burrs developed in, for example, an open edge portion of the scavenging port during the removal from the casting mold assembly can be easily removed with a high workability. Also, since the structure necessary to introduce the air from the air passage into the scavenging passage through the introducing passage is provided between the scavenging block and the covering member, secured to the cylinder block, and the cylinder block, the structure can be simplified and can therefore be manufacture inexpensively as compared with the structure, in which the air is introduced into the scavenging passage through the recess in the outer periphery of the reciprocating piston such as disclosed in the previously mentioned patent publication No. 2008-138602.

In a preferred embodiment of the present invention, an upper edge of the scavenging port opening towards the combustion chamber may be formed by a scavenging port upper edge portion in a peripheral wall of the cylinder block, in which case a radially inner end of the upper portion of the scavenging block is positioned at a location radially outwardly of the scavenging port upper edge portion. This is particularly advantageous that since the timing, at which the scavenging port is opened during the descending motion of the reciprocating piston, is determined uniquely by the position of the upper edge portion of the scavenging port formed in the peripheral wall of the cylinder block itself, there is no possibility that the timing of scavenging with the air will be varied even though a radially inner end of the upper portion of the scavenging block displaces in position relative to the upper edge of the scavenging port in the cylinder block. This characteristic structure can readily be accomplished by, for example, allowing the radially inner end of the upper portion of the scavenging block to engage a stepped portion defined in a radially outer portion of the peripheral wall of the cylinder block relative to the scavenging port upper edge portion.

In a preferred embodiment of the present invention, the scavenging block may be received within a scavenging opening defined in a peripheral wall of the cylinder block so as to extend completely through a portion of such peripheral wall, and the covering member may be fitted to a radially outer end face of the scavenging opening. According to this construction, since each of the scavenging block and the covering member are prepared using the members separate from each other, the freedom of choice in, for example, shape and manufacturing method of the respective scavenging block can be increased.

In another preferred embodiment of the present invention, there may be provided a first scavenging passage for supplying mainly an air/fuel mixture within the crank chamber to the combustion chamber and a second scavenging passage for supplying mainly an air from the introducing passage to the combustion chamber and in which the introducing passage is communicated with the second scavenging passage through a radially outer side of the first scavenging passage. By so doing, that part of the introducing passage communicated with the second scavenging passage by way of the radially outer side of the first scavenging passage can be easily formed integrally with the scavenging block. Also, by setting the passage area of the communicating portion leading from the introducing passage in the scavenging block towards the second scavenging passage to an arbitrarily chosen value, the amount of the air introduced from the air passage into the second scavenging passage can be adjusted.

In a further preferred embodiment of the present invention, a radially outer side portion of a passage wall forming the first scavenging passage may be formed with an introducing hole through which the air within the introducing passage is introduced. This is particularly advantageous that introduction of the air, guided from the air passage into the introducing passage, also into the first scavenging passage makes it possible to secure the amount of the air sufficient to avoid an undesirable blow-off in combination in cooperation with the air within the second scavenging passage.

Where the use of the first and second scavenging passages is made, the scavenging block referred to above is preferably formed integrally with a passage upper wall portion extending in a radial direction, and first and second partition wall portions extending downwardly from an inner side half of the passage upper wall portion occupying a region from a radially inner end portion of the passage upper wall portion to an intermediate portion thereof and, also, an upper portion of the first scavenging passage is preferably formed between the first partition wall portion and the second partition wall portion and an upper portion of the second scavenging passage is formed between the second partition wall portion and the cylinder block. With this construction, since the first and second partition wall portions are integrally formed the scavenging block, the upper portions of the first and second scavenging passages can be easily formed.

Where the first partition wall portion and the second partition wall portion are formed integrally with the scavenging block, first and second guide wall portions are further formed integrally with the scavenging block so as to extend downwardly from a lower surface of the passage upper wall portion and continued to respective upper side faces of the first partition wall portion and the second partition wall portion and, also, the first and second guide wall portions preferably have a length as measured in a vertical direction, which is smaller than the respective heights of the first and second partition wall portions and also preferably have respective guide faces inclined diagonally upwardly from corresponding lower end portions towards inner ends. Since the air/fuel mixture and the air are guided respectively by the guide faces to be supplied into the combustion chamber diagonally upwardly, the air/fuel mixture and the air charged in the combustion chamber with high efficiency.

Where the first partition wall portion and the second partition wall portion are formed integrally with the scavenging block, the scavenging block is preferably connected with a scavenging opening in the cylinder block; an upstream portion of the introducing passage is formed between a peripheral wall of the scavenging opening and the first partition wall portion and, also, a downstream portion of the introducing passage is preferably formed below an outer half of the passage upper wall portion ranging from sites aligned with radially outer ends of the first and second partition wall portions in the passage upper wall portion to a radially outer end of the passage upper wall portion. With this construction, the introducing passage can be easily provided by a combination of the peripheral wall of the scavenging opening with the scavenging block.

In a yet further preferred embodiment of the present invention, a first stepped portion may be formed in a front end region of a passage upper wall portion in the scavenging block so as to protrude upwardly, and a second stepped portion depressed upwardly to allow the first stepped portion to contact therewith may then be formed in a radially outer portion of an upper edge of the scavenging port open towards the combustion chamber in the cylinder block. According to this structural feature, since the upper edge of the first scavenging port is formed by the scavenging port upper edge portion in the peripheral wall of the cylinder block, even when variation occurs in a vertical position of the front end region of the passage upper wall portion in the scavenging block, the timing at which the first scavenging port is opened is uniquely determined by the upper edge portion of the first scavenging port without being affected by such variation, with the variation consequently minimized as much as possible.

Any combination of at least two of the various constructions disclosed in the appended claims, the specification and/or the accompanying drawings in this application should be construed as included within the spirit of the present invention. In particular, any combination of two or more of the appended claims should also be construed as included within the spirit of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
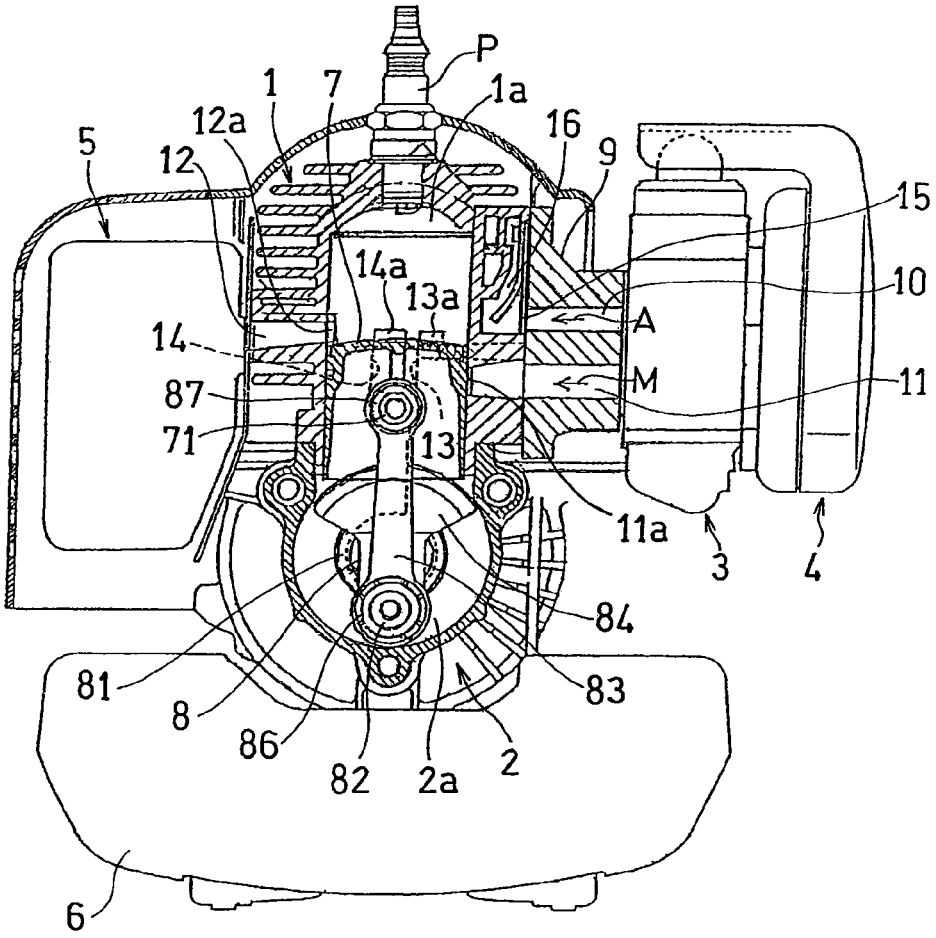
FIG. 1 is a transverse sectional view showing a two-stroke cycle combustion engine according to a first preferred embodiment of the present invention.

Hereinafter, preferred embodiments of the present invention will be described in detail with particular reference to the accompanying drawings. In particular, in a two-stroke cycle combustion engine designed in accordance with a first preferred embodiment of the present invention shown in FIG. 1, a cylinder block 1 having a combustion chamber 1*a* defined therein is fixedly mounted on a crankcase 2 having a crank chamber 2*a* defined therein. The cylinder block 1 and the crankcase 2 are each in the form of a cast product made of a metallic material such as, for example, an aluminum alloy and shaped by a casting mold assembly. The cylinder bore defined in the cylinder block 1 accommodates therein the piston 7 for reciprocating movement within the cylinder bore in a direction parallel to the longitudinal axis thereof (vertical direction in FIG. 1) with the combustion chamber 1*a* defined between it and a top wall of the cylinder bore.

A carburetor 3 and an air cleaner 4, forming respective parts of a fuel supply device which in turn forms an intake system, are connected with an one side portion (right side portion as viewed in FIG. 1) of the cylinder block 1 and a muffler 5, forming a part of an exhaust system, is connected with the opposite side portion (left side portion thereof). A fuel tank 6 is disposed beneath the crankcase 2.

A crankshaft 8 is operatively supported within the crankcase 2 by means of bearings 81 for rotation about its own longitudinal axis. The crankshaft 8 has a hollow crank pin 82 mounted on a portion thereof offset from the longitudinal axis of the crankshaft 8, and the crank pin 82 and a hollow piston pin 71, provided in the reciprocating piston 7 for movement together therewith, are operatively connected with each other by means of a connecting rod 83 through a large end bearing 86 and a small end bearing 87. The crankshaft 8 is provided with a crank web 84, and an ignition plug P is provided on a top area of the cylinder block 1.

An insulator 9 made of a resinous material is interposed between the cylinder block 1 and the carburetor 3 for thermally insulating the carburetor 3 from heat evolved in the cylinder block which is heated to an elevated temperature during the operation of the combustion engine. A portion of an air passage 10 for supplying an air A, which has been drawn from the outside, is formed within an upper region of the insulator 9 and, also, a portion of an air/fuel mixture passage 11 is formed within a lower region of the insulator 9 at a location below the air passage 10 so as to extend substantially parallel to the air passage 10. The air/fuel mixture passage 11 is communicated with a mixture port 11*a* defined in the cylinder block 1 so as to open at an inner peripheral surface of the cylinder block 1 in communication with the cylinder bore.

The carburetor 3 is operable to adjust both of respective passage cross-sectional areas (hereinafter referred to as "passage area") of the air passage 10 and the air/fuel mixture passage 10 by means of a single rotary valve (not shown). Also, the cylinder block 1 is formed with an exhaust passage 12 having an exhaust port 12*a* open at the inner peripheral surface of the cylinder block 1 in communication with the cylinder bore. The exhaust port 12*a* and the air/fuel mixture port 11*a* referred to previously are defined in the inner peripheral surface of the cylinder block 1 at respective locations spaced 180° from each other in a direction circumferentially of the cylinder bore. Exhaust gases (combustion gases) discharged from the combustion chamber 1*a* into the exhaust passage 12 through the exhaust port 12*a* are subsequently discharged from an exhaust opening (not shown) to the outside by way of the muffler 5.

Figure 2:
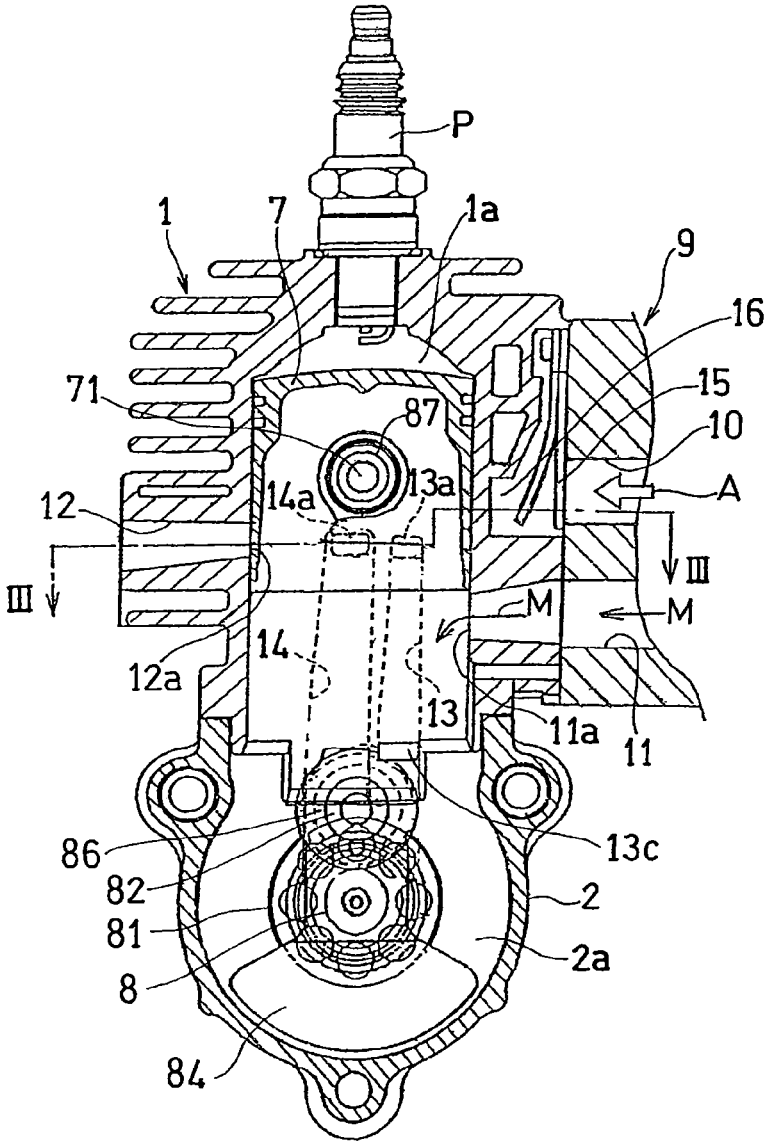
FIG. 2 is a somewhat enlarged transverse sectional view showing a cylinder block and a crankcase both employed in the two-stroke cycle combustion engine shown in FIG. 1.

As shown in FIG. 2, a first scavenging passage 13 is in part defined in the cylinder block 1 and in part in the crankcase 2 so as to fluid connect the combustion chamber 1*a* directly with the crank chamber 2*a* and a second scavenging passage 14 for fluid connecting between the combustion chamber 1*a* and the crank chamber 2*a* through the bearing 81 for the crankshaft 8 is formed on one side of the first scavenging passage 13 adjacent the exhaust port 12*a*. The first and second scavenging passages 13 and 14 best shown in FIG. 2 have respective upper ends defining first and second scavenging ports 13*a* and 14*a*, which are disposed at a level lower than that of an uppermost edge of the exhaust port 12*a* and, at the same time, the second scavenging port 14*a* has its uppermost edge disposed at a level higher than that of an uppermost edge of the first scavenging port 13*a*.

Figure 3:
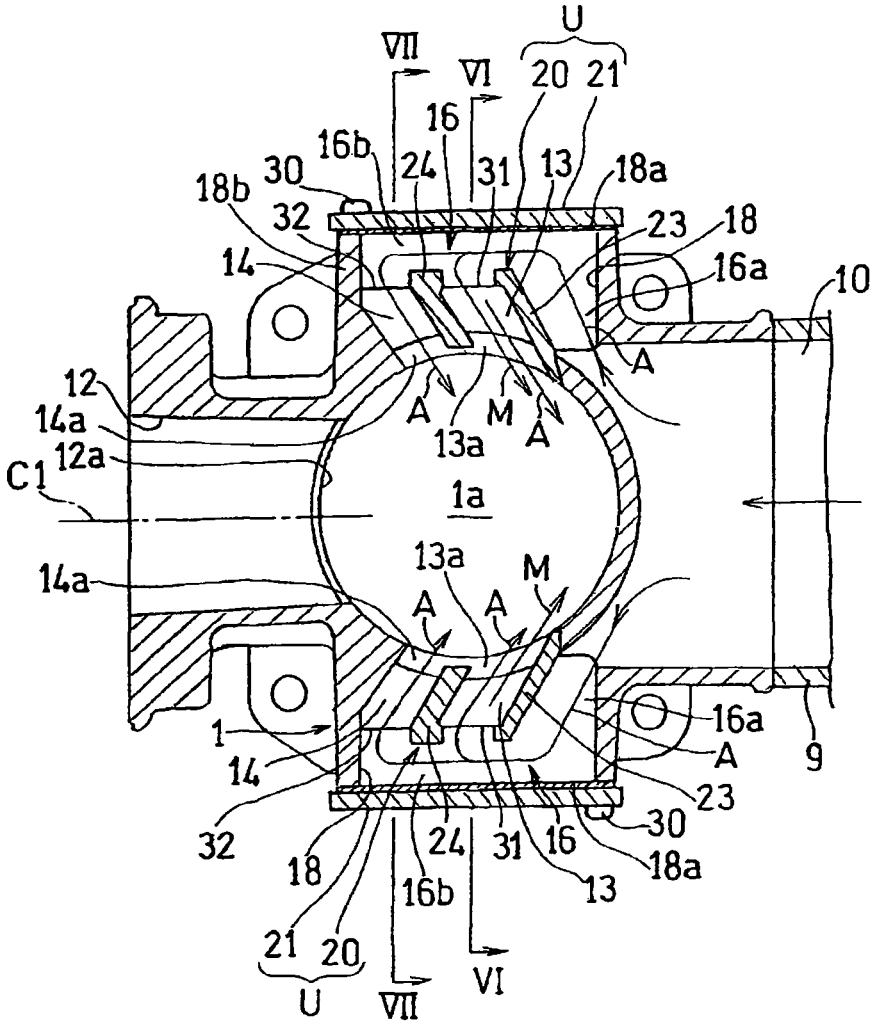
FIG. 3 is a cross sectional view taken along the line III-III in FIG. 2.

As best shown in FIG. 3 showing a cross sectional representation taken along the line III-III in FIG. 2, each of the first and second scavenging passages 13 and 14 is composed of a pair of passages disposed on each of the longitudinal axis C1 of the exhaust passage 12 in a substantially symmetrical relation with respect to such longitudinal axis C1, although in practice, however, the present invention can satisfactorily work even though the use is made of at least one first scavenging passage in combination with at least one second scavenging passage. Accordingly, unless otherwise specified, reference will be made only to one of the first scavenging passages 13 and, correspondingly, one of the second scavenging passages 14 in the following description for the sake of clarity.

The air A flowing through the air passage 10 in the insulator 9 is once introduced into the second scavenging passages 14 through associated introducing passages 16 (best shown in FIG. 3), as will be described in detail later, by the effect of a negative pressure developed within the crank chamber 2*a* during the intake stroke of the combustion engine during which the reciprocating piston 7 ascends towards the top dead center position, and at the same time, a pair of the air A is once introduced into the first scavenging passage 13. On the other hand, the air/fuel mixture M flowing through the mixture passage 11 best shown in FIG. 2 is introduced directly from the associated mixture ports 11*a*, defined in the inner peripheral surface of the cylinder block 1, into the crank chamber 2*a* by the effect of the negative pressure developed within the crank chamber 2*a* during the intake stroke during which the reciprocating piston 7 ascends towards the top dead center position.

As best shown in FIG. 3, the introducing passages 16 are defined in the cylinder block 1 so as to communicate the air passage 10 with the first scavenging passages 13 and also with the second scavenging passages 14. Also, a pair of introducing passage upstream portions 16*a*, both communicated with the air passage 10, are defined in the cylinder block 1 at respective locations closer to the insulator 9 than to the associated first scavenging passages 13. Radial scavenging openings 18 extending completely across respective portions of a peripheral wall of the cylinder block 1 in a direction radially outwardly of the latter are formed in radially opposed portions of the outer peripheral wall of the cylinder block 1 and at positions radially outwardly of the corresponding first and second scavenging passages 13 and 14.

Figure 4:
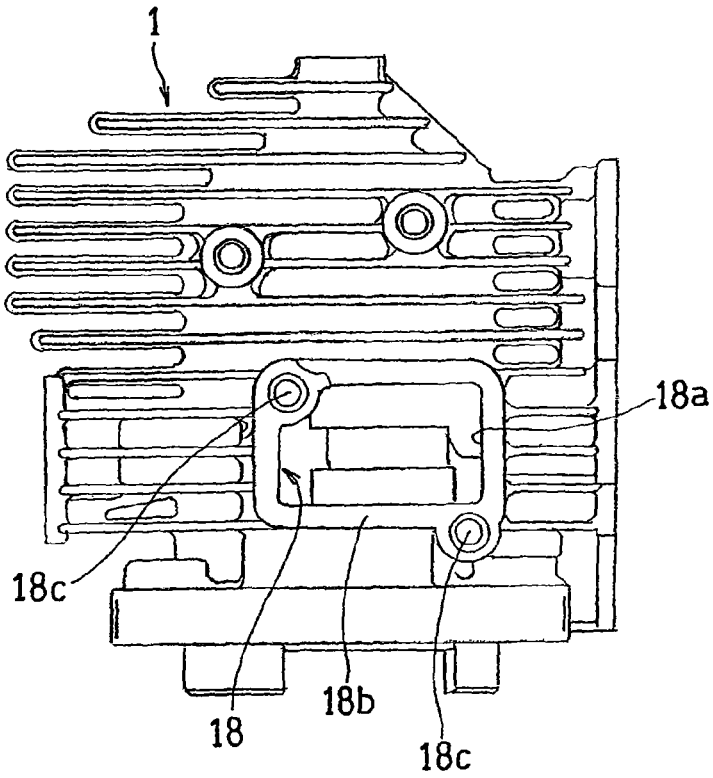
FIG. 4 is a fragmentary side view showing the cylinder block for the two-stroke cycle combustion engine shown in FIG. 1.

Each of those radial scavenging openings 18 has an open edge 18*a* defined at a location remote from the cylinder bore, and an introducing passage downstream portion 16*b* is defined in the cylinder block 1 so as to extend between the open edge 18*a* of each of the radial scavenging openings 18 and the adjacent first and second scavenging passages 13 and 14. Each of the radial scavenging openings 18 is closed from the outer side by a corresponding covering member 21, while such scavenging block 20 as will be described in detail later, is engaged in the corresponding scavenging opening 18. The covering member 21 for each of the scavenging openings 18 is secured to the cylinder block 1 with bolts 30 threaded into a pair of respective threaded holes 18*c* which are defined in a rectangular opening peripheral wall 18*b* surrounding the corresponding scavenging opening 18 in the cylinder block 1 as shown in FIG. 4. In this embodiment, the scavenging blocks 20 and covering member 21 are formed integrally with each other as a single unit U.

The details of each of the scavenging blocks 20, secured to the cylinder block 1 in the manner described above, are best shown in FIGS. 5A to 5D. As shown therein, each of the scavenging blocks 20 is of one piece construction, formed integrally by means of molding such as, for example, casting, including the covering member 21 having mounting holes 27, 27 defined therein for receiving the bolts 30 (best shown in FIG. 4) referred to above, a passage upper wall portion 22 extending in a radial direction, in detail, from an inner surface top portion of the covering member 21 in a direction perpendicular to the covering member 21, first and second partition wall portions 23 and 24 extending downwardly from an inner side half 22*c* (FIG. 5B) of the passage upper wall portion 22 occupying a region from a radially inner end 22*a* of the passage upper wall portion 22, spaced from the covering member 21, to an intermediate portion thereof, and first and second guide wall portions 25 and 26 extending downwardly from an undersurface of the passage upper wall portion 22 and continued to respective upper side faces of the first and second partition wall portions 23 and 24. The guide wall portions 25 and 26 have a length as measured in a vertical direction, which is smaller than the respective heights of the first and second partition wall portions 23 and 24, and have respective guide faces 25*a* and 26*a* inclined diagonally upwardly from corresponding lower end portions towards tips (inner ends).

The scavenging block 20 is secured to the cylinder block 1 by means of the bolts 30 (FIG. 3), inserted through the mounting holes 27, 27 (FIG. 5A) in the covering member 21, with the passage upper wall portion 22, the first partition wall portion 23, the second partition wall portion 24 and the guide wall portions 25 and 26 having been engaged inside the respective scavenging opening 18 best shown in FIG. 4.

Figure 6:
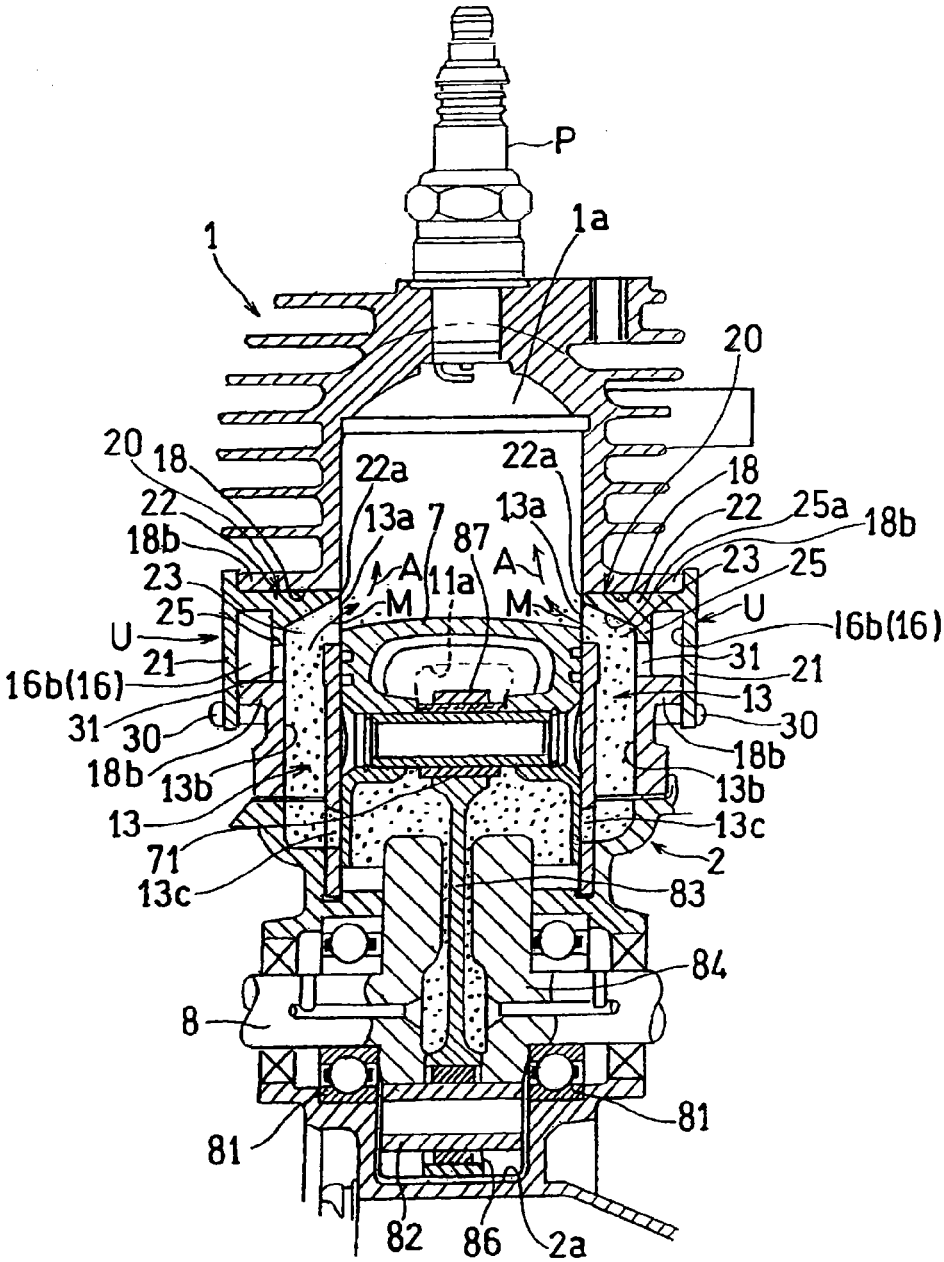
FIG. 6 is a cross sectional view taken along the line VI-VI in FIG. 3, showing the details of portions of first scavenging passages in the two-stroke cycle combustion engine.

The first scavenging passage 13 formed in the peripheral wall of the cylinder block 1 as shown in FIG. 6 has a first scavenging port 13*a* open at the inner peripheral surface of the cylinder block 1, a vertically extending communicating passage 13*b* extending from the first scavenging port 13*a* to an upper portion of the crankcase 2 past a lower end of the cylinder block 1, and an inflow port 13*c* open at an inner peripheral surface of the upper portion of the crankcase 2. The introducing passage downstream portion 16*b* defined laterally outwardly of the first scavenging passage 13 is delimited by the covering member 21, an outer half of the passage upper wall portion 22, the first partition wall portion 23, the first guide wall portion 25, each of which forms a part of the scavenging block 20 and a lower portion of the opening peripheral wall 18*b* of the cylinder block 1.

The passage upper wall portion 22 of each of the scavenging blocks 20 is inserted along an upper edge portion of the corresponding scavenging opening 18 and has its radially inner end 22*a* positioned in flush with a peripheral wall inner surface of the cylinder block 1. Accordingly, an upper end portion of the first scavenging port 13*a* is defined by the passage upper wall portion 22 of the respective scavenging block 20.

The first partition wall portion 23 of the scavenging block 20 partitions between the introducing passage downstream portion 16*b* and the upper portion of the first scavenging passage 13 and an introducing hole 31 for introducing an air within the introducing passage downstream portion 16*b* into the first scavenging passage 13 is formed between a lower end of the first guide wall portion 25 and a lower portion of the opening peripheral wall 18*b* of the cylinder block 1. Accordingly, during the intake stroke with the reciprocating piston 7 ascending towards the top dead center position, a portion of the air A flowing through each of the introducing passages 16 is introduced through the corresponding introducing hole 31 into the upper portion of the first scavenging passage 13 for supplying mainly the air/fuel mixture M within the crank chamber 2*a* to the combustion chamber 1*a*.

It is to be noted that in the practice of the present invention, the use of the introducing holes 31 one for each of the first scavenging passage 13 may be dispensed with.

Figure 7:
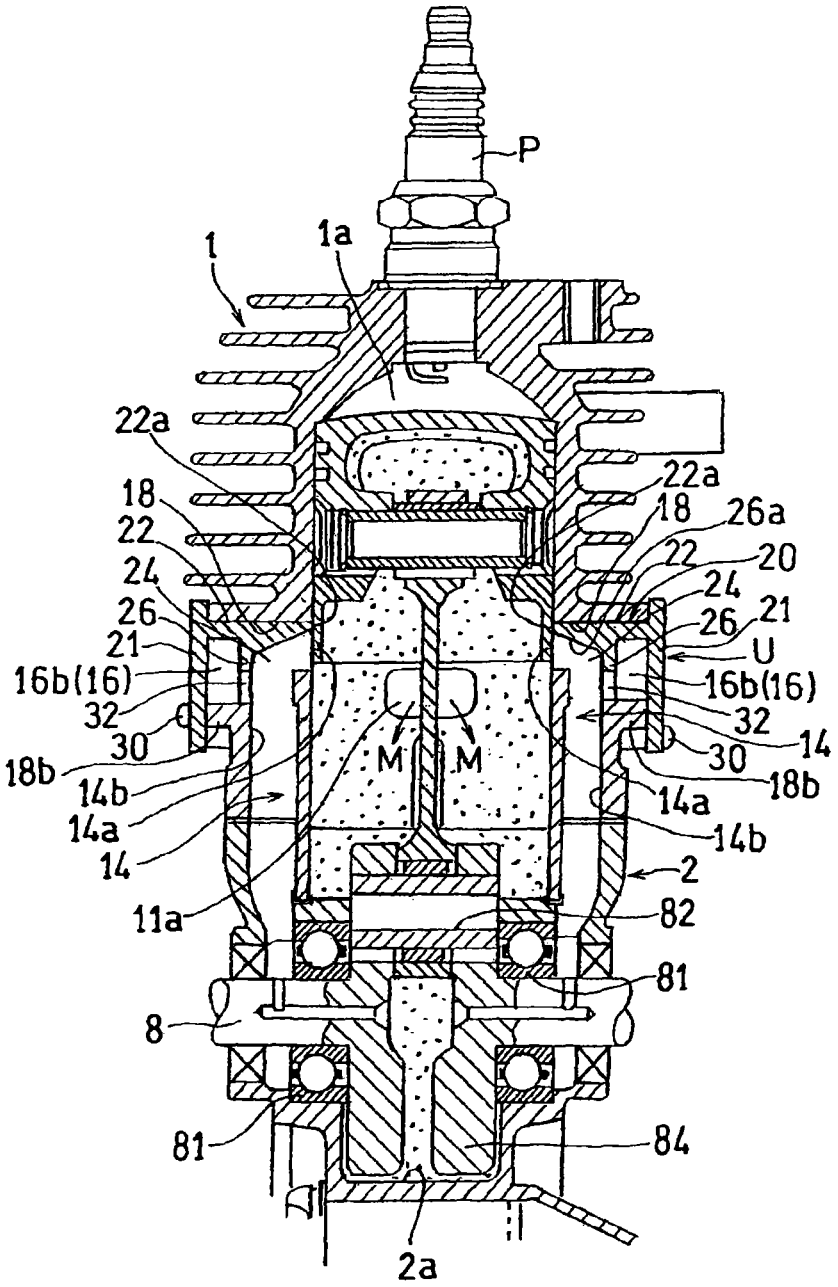
FIG. 7 is a cross sectional view taken along the line VII-VII in FIG. 3, showing the details of second scavenging passages in the two-stroke cycle combustion engine.

As best shown in FIG. 7, each of the second scavenging passages 14 has a second scavenging port 14*a*, open at the inner peripheral surface of the cylinder block 1, and a vertically extending communicating passage 14*b* extending from the second scavenging port 14*a* to an outer side face of the adjacent crankshaft bearing 81, which is situated at a level intermediate of the height of the crankcase 2, past the lower end of the cylinder block 1. The communicating passage 14*b* has a lower end communicated with the crank chamber 2*a* through a gap between inner and outer rings of the respective crankshaft bearing 81 and then through a gap between the crank web 84 and the crankshaft bearing 81. The introducing passage downstream portion 16*b* referred to previously is delimited by the covering member 21, an outer half of the passage upper wall portion 22, the second guide wall portion 26, each of which forms a part of the scavenging block 20, and a lower portion of the opening peripheral wall 18*b* of the cylinder block 1 and extends laterally outside the second scavenging passage 14.

In this way, the introducing passage upstream portion 16*a* is formed between the opening peripheral wall 18*b* of the scavenging opening 18, best shown in FIG. 3, and adjacent first partition wall portion 23, and the introducing passage downstream portion 16*b* is formed below the outer half 22*d* of the passage upper wall portion 22, ranging from an intermediate portion of the passage upper wall portion 22 shown in FIG. 5B, that is, from respective sites aligned with radial outer ends 23*e* and 24*e* of the first and second partition wall portions 23 and 24 (FIG. 7) to a radial outer end 22*e* of the passage upper wall portion 22, that is, an inner surface of the covering member 21.

Even in the second scavenging passage 14 best shown in FIG. 7, the passage upper wall portion 22 of the corresponding scavenging block 20 inserted into the scavenging opening 18 has a radially oriented inner end 22*a* positioned in flush with the peripheral wall inner surface of the cylinder block 1. Accordingly, an upper end portion of the second scavenging port 14*a* is defined by the passage upper wall portion 22 of the scavenging block 20.

The second partition wall portion 24 of the scavenging block 20 partitions between an upper portion of the first scavenging passage 13 (as shown in FIG. 6) and an upper portion of the second scavenging passage 14, and a communicating port 32, through which the introducing passage downstream portion 16*b* is communicated with the second scavenging passage 14, is defined between a lower end of the second guide wall portion 26 and the cylinder block 1. Accordingly, the air A flowing through the introducing passage 16 during the intake stroke is introduced into the second scavenging passage 14 through the communicating port 32 referred to above.

In other words, as best shown in FIG. 3, the upper portion of the first scavenging passage 13 is formed between the first partition wall portion 23 and the second partition wall portion 24 and the upper portion of the second scavenging passage 14 is formed between the second partition wall portion 24 and the inner peripheral wall of the cylinder block 1. Since the first and second partition wall portions 23 and 24 are integrally formed the scavenging block 20, the upper portions of the first and second scavenging passages 13 and 14 can be easily formed. As best shown in FIG. 2, an downstream side outlet of the air passage 10 defined in the insulator 9 is provided with a reed valve 15 which closed the air passage 10 when the pressure inside the introducing passage 16 communicated with such downstream side outlet of the air passage 10 is reduced to a value lower than a predetermined value.

The operation of the two-stroke cycle combustion engine of the construction described herein before will now be described.

When as shown in FIG. 7 the reciprocating piston 7 within the cylinder block 1, then held under the intake stroke, reaches the top dead center position with a negative pressure consequently developed within the cylinder bore of the cylinder block 1 and the crank chamber 2*a*, the air/fuel mixture M is introduced directly from the mixture port 11*a*, open at the inner peripheral surface of the cylinder block 1, into the crank chamber 2*a*. By the flow of the air/fuel mixture M so introduced, the large end bearing 86 and the small end bearing 87, both best shown in FIG. 2, are lubricated. Since at this time, a negative pressure is developed inside the first scavenging passages 13, communicated directly with the crank chamber 2*a*, and also inside the second scavenging passages 14*d*, communicated with the crank chamber 2*a* through the corresponding crankshaft bearings 81, the pressures inside the introducing passages 16, connected to the first and second scavenging passages 13 and 14, become negative enough to open the reed valve 15 fitted to an outlet of the air passage 10 in the insulator 9 and, as a result thereof, the air A within the air passage 10 is once introduced from the introducing passages 16, shown in FIG. 3, into the first and second scavenging passages 13 and 14 through the introducing ports 31 and then through the communicating ports 32.

When as hereinabove described the reed valve 15 is opened by the effect of the negative pressure inside the crank chamber 2*a*, best shown in FIG. 2, during the intake stroke, the air A is introduced not only into the second scavenging passages 14, but also into the first scavenging passages 13 and, therefore, an amount of air sufficient to avoid an undesirable blow-off of the air/fuel mixture M can be secured.

During the subsequent scavenging stroke, as best shown in FIG. 3, the air A is first introduced into the combustion chamber 1*a* from the first and second scavenging ports 13*a* and 14*a* of the first and second scavenging passages 13 and 14 and, at the same time, the air/fuel mixture M introduced from the mixture passage 11 (best shown FIG. 2) into the crank chamber 2*a* is jetted into the combustion chamber 1*a* through the first scavenging passage 13 by way of the first scavenging ports 13*a*. Since at this time, the air A is first jetted from the first scavenging ports 13*a* and the second scavenging ports 14*a* and the air/fuel mixture M is jetted from the first scavenging port 13*a* in a fashion slightly delayed relative to the jetting of the air A with the air A being introduced into the combustion chamber 1*a* from a location closer to the exhaust port 12*a* than the air/fuel mixture M, the undesirable blow-off of the air/fuel mixture M from the exhaust port 12*a* can be avoided by the action of the air A so introduced earlier than the air/fuel mixture M.

The amount of the air A jetted from the first scavenging ports 13*a* is smaller than that from the second scavenging port 14*a* and the first scavenging port 13*a* mainly supplies the air/fuel mixture M to the combustion chamber 1*a*. It may occasionally occur that the air A is mainly supplied from the second scavenging ports 14*a* into the combustion chamber 1*a* and, following the air A so supplied, a small amount of the air/fuel mixture M is supplied into the combustion chamber 1*a*.

Since the air/fuel mixture M and the air A are guided respectively by the guide faces 25*a* and 26*a* to be supplied into the combustion chamber 1*a* diagonally upwardly, the air/fuel mixture M and the air A charged in the combustion chamber 1*a* with high efficiency.

Figure 5B:
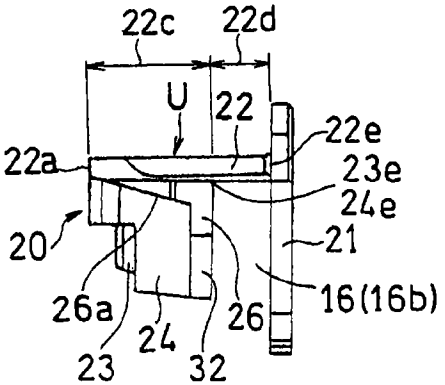
FIG. 5B is a side view of the scavenging block shown in FIG. 5A.
Figure 5D:
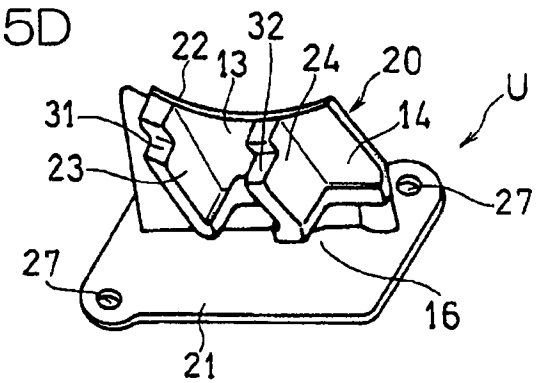
FIG. 5D is a perspective view showing the scavenging block as viewed in the direction shown by d in FIG. 5A.
Figure 5A:
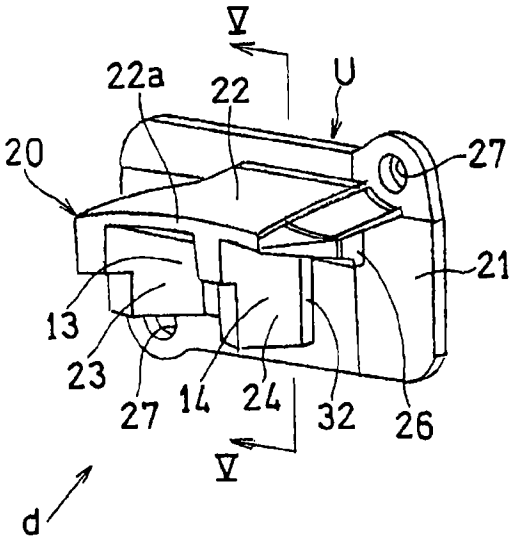
FIG. 5A is a perspective view showing a scavenging block of the two-stroke cycle combustion engine as viewed from the interior thereof.
Figure 5C:
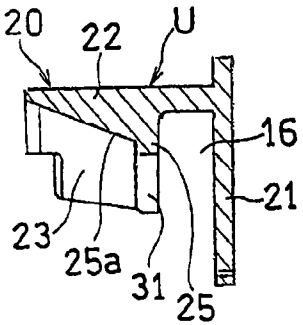
FIG. 5C is a cross sectional view taken along the line V-V in FIG. 5A.

In the two-stroke cycle combustion engine designed according to the foregoing embodiment, each of the scavenging blocks 20 best shown in FIG. 5A is of one piece construction including the covering member 21 which covers the introducing passage 16, shown in FIGS. 5B and 5C, from outside, the passage upper wall portion 22 which defines the respective upper portions of the first scavenging passage 13 and the second scavenging passage 14, and the first and second partition wall portions 23 and 24 forming a part of the associated introducing passage 16. Accordingly, in the cylinder block 1 before the respective scavenging blocks 20 are secured thereto as best shown in FIG. 6, the scavenging openings 18 defined in the cylinder block 1 for receiving therein the respective scavenging blocks 20 are exposed to the outside. Therefore, access can be made radially inwardly to the radially inner end portion of each of the scavenging openings 18, that is, the radially inner end edge of the first and second scavenging ports 13*a* and 14*a* through the respective scavenging opening 18 and, hence, casting burrs or flashes appearing in an edge portion of each of the scavenging openings 18 subsequent to the removal of the cylinder block 1 from the casting mold assembly can be easily removed with a high workability.

Also, since each of the scavenging blocks 20 made up of a number of members formed integrally therewith comes to have a large shape, each of the scavenging openings 18 defined in the cylinder block 1 for receiving therein the corresponding scavenging block 20 can have an increased open area, thus facilitating removal of the casting burrs or flashes. Yet, since the structure is employed between the cylinder block 1 and each of the scavenging blocks 20, in which the air A from the air passage 10 can be introduced into the first and second scavenging passages 13 and 14 through the corresponding introducing passage 16, as compared with the structure in which the air is introduced into the scavenging passage through the recess defined in the outer periphery of the reciprocating piston such as disclosed in the previously mentioned JP Laid-open Patent Publication No. 2008-138602, the structure can be simplified, allowing it to be manufactured at a low cost.

Also, as FIG. 3 makes it clear, since each of the introducing passage 16 positioned radially outwardly of the adjacent first scavenging passage 13 is communicated with the second scavenging passage 14, a part of the introducing passage 16 can be easily formed integrally with the corresponding scavenging blocks 20. In addition, the passage area of each of the introducing passage 16 can be arbitrarily chosen to any desired value when the corresponding scavenging block 20 is changed in shape, wherefore the amount of the air introduced from the air passage 10 into the second scavenging passage 14 can be easily adjusted.

Also, since each of the introducing passages 16 is of such a structure as to extend radially outwardly of the adjacent first scavenging passage 13, the corresponding introducing hole 31, through which the air A within the respective introducing passage 16 is introduced also into the first scavenging passage 13, can be easily formed between the cylinder block 1 and the partition wall portions 23 and 24 forming respective parts of passage walls of the first and second scavenging passages 13 and 14 in the associated scavenging block 20. Accordingly, the amount of the air sufficient to avoid the undesirable blow-off of the air/fuel mixture M can be secured owning to the air A introduced from the introducing passages 16 into the associated first scavenging passages 13.

Figure 8:
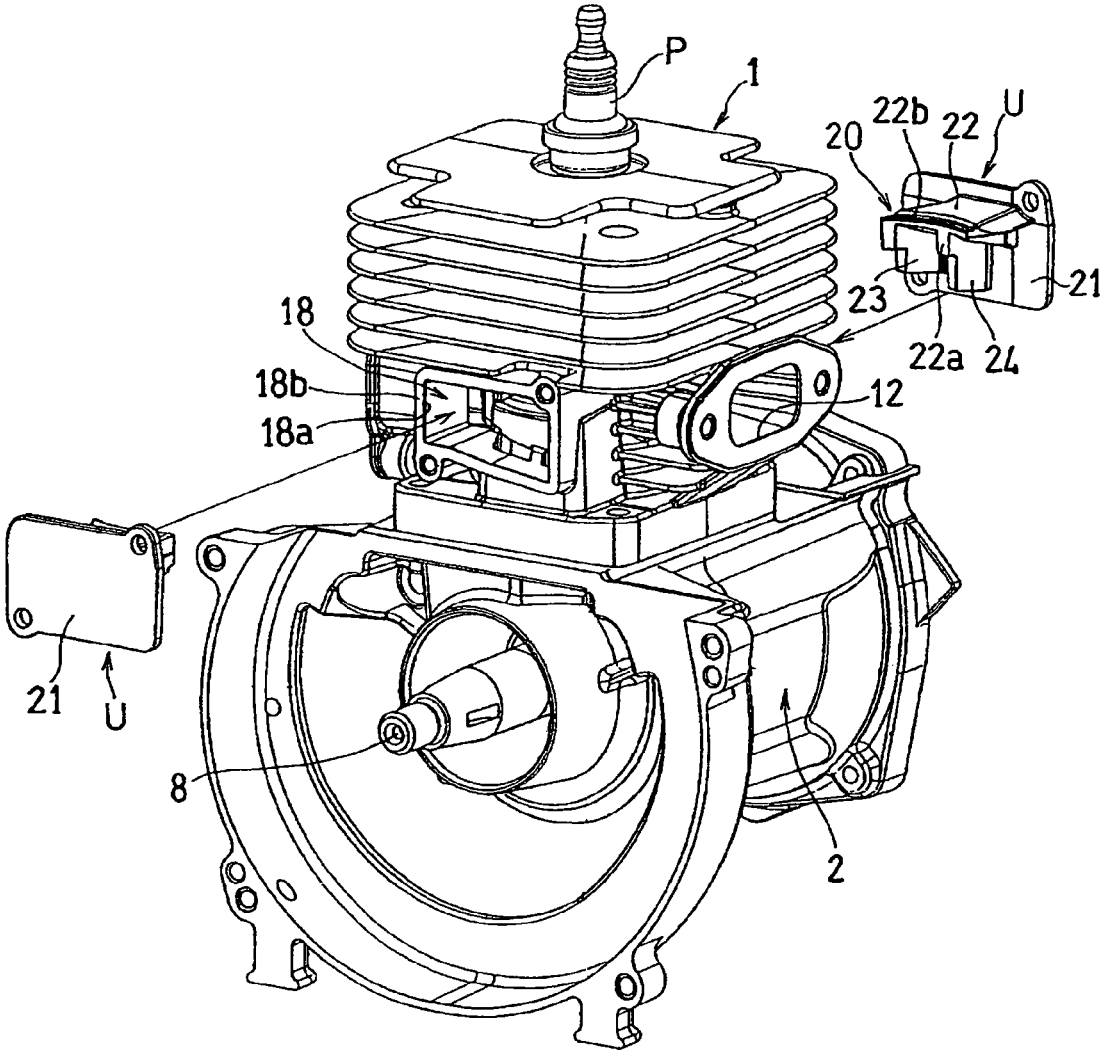
FIG. 8 is an exploded perspective view showing the two-stroke cycle combustion engine according to a second preferred embodiment of the present invention.

FIG. 8 illustrates an exploded perspective view of the two-stroke cycle combustion engine according to a second preferred embodiment of the present invention with the scavenging blocks 20 removed. In this second embodiment, a first stepped portion 22*b* is formed in a front end region or in vicinity of the radially inner end 22*a* of the passage upper wall portion 22 in each of the scavenging blocks 20 so as to protrude upwardly, and as best shown in FIG. 9 showing a transverse sectional view of a portion of the cylinder block 1, which has the scavenging blocks 20 secured thereto, a second stepped portion 1*b* depressed upwardly to allow the first stepped portion 22*b* to contact therewith is formed in a radially outer portion of an upper edge of the first scavenging port 13*a* open towards the combustion chamber 1*a* in the cylinder block 1.

In the two-stroke cycle combustion engine according to the previously described first embodiment, there is the possibility that when the respective scavenging block 20 is secured to the cylinder block 1 as shown in FIG. 6, because of a slight gap, which is present between each mounting hole 27 in the respective scavenging block 20 as best shown in FIG. 5A and the associated bolt 30 that is passed through such mounting hole 27, or dimensional errors occurring in the corresponding scavenging block 20 and the cylinder block 1, the vertical position of the radially inner end 22*a* of the passage upper wall portion 22 may vary by a quantity corresponding to such slight gap or such dimensional errors. This variation may lead to variation in timing at which the first scavenging port 13*a* is opened by the reciprocating piston 7 then descending during the scavenging stroke.

Figure 9:
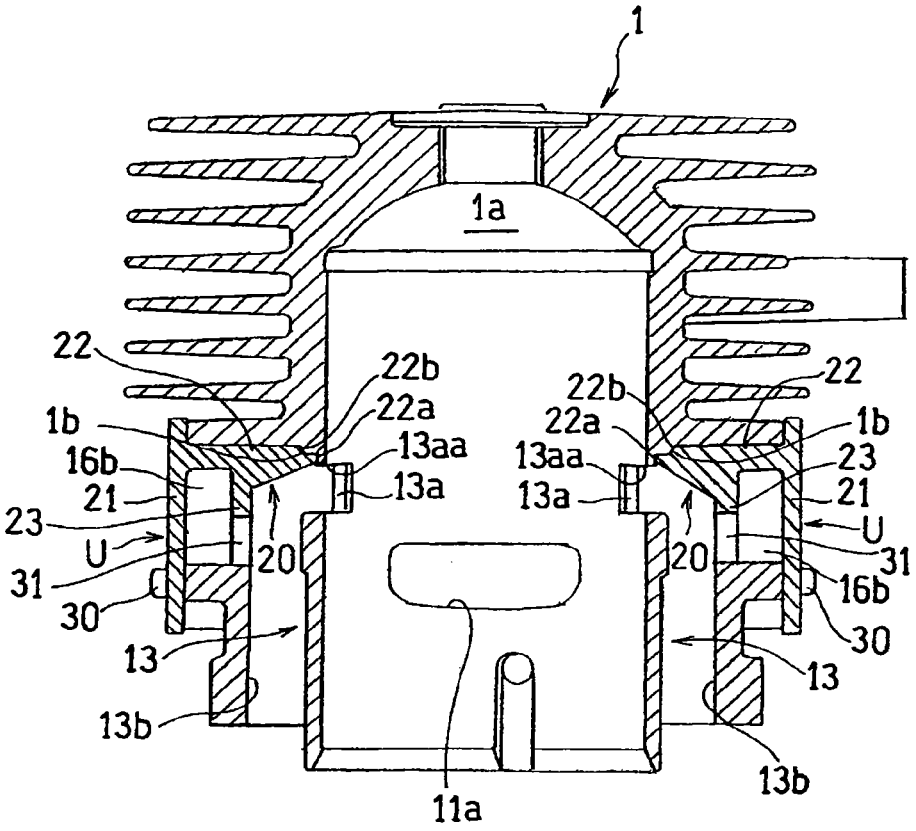
FIG. 9 is a transverse sectional view of a portion of the cylinder block of the two-stroke cycle combustion engine of FIG. 8, which has the scavenging block fitted to, showing the details of the second scavenging passages.

In contrast thereto, in the two-stroke cycle combustion engine designed according to the second embodiment, the upper edge of the first scavenging port 13*a* open towards the combustion chamber 1*a* shown in FIG. 9 is formed by a scavenging port upper edge portion 13*aa* in the peripheral wall of the cylinder block 1 and, accordingly, even when variation occurs in the vertical position of the radially inner end 22*a* of the passage upper wall portion 22 in the scavenging block 20, the timing at which the first scavenging port 13*a* is opened is uniquely determined by the upper edge portion 13*aa* of the first scavenging port 13*a* without being affected by such variation, with the variation consequently minimized as much as possible. This equally applies to the second scavenging port 14.

Figure 10:
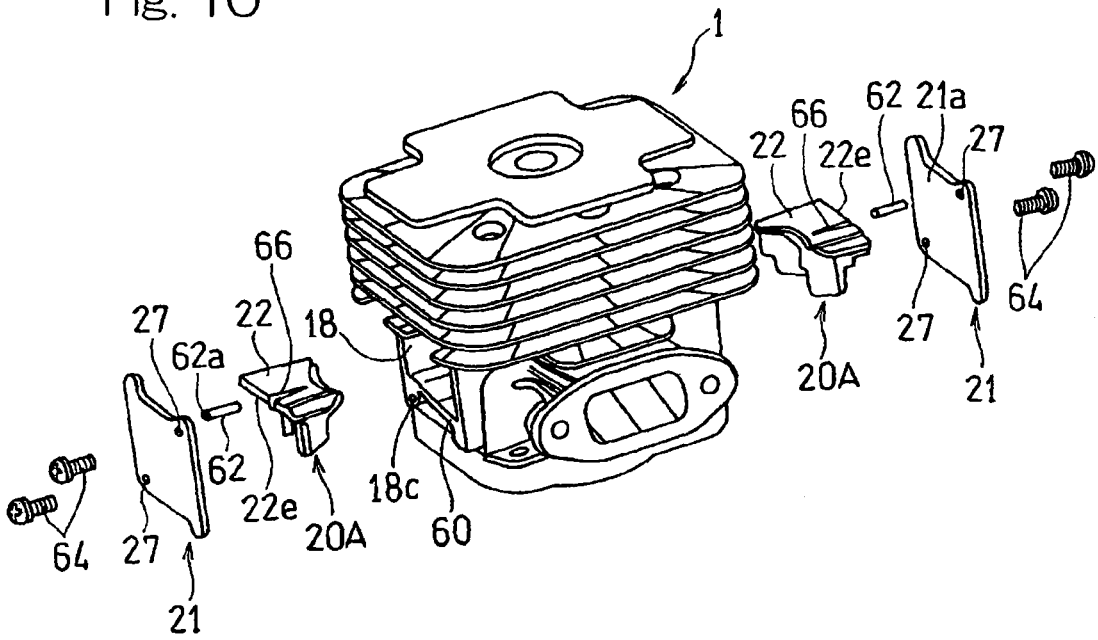
FIG. 10 is an exploded perspective view showing a cylinder block of the two-stroke cycle combustion engine according to a third preferred embodiment of the present invention.

FIG. 10 is a perspective view showing a disassembled condition of the cylinder block 1, the scavenging block 20A and the covering member 21 all employed in the two-stroke cycle combustion engine designed according to a third preferred embodiment of the present invention. In this third embodiment, the scavenging block 20A and the covering member 21 are not formed integrally with each other and are formed as respective members separate from each other. The covering member 21 is of a plate-like configuration. Each of the scavenging block 20A is received within the corresponding scavenging opening 18 and fitted to the cylinder block 1 by means of a respective spring pin 62, which forms a first fitting member, and, on the other hand, the covering member 21 is detachably fitted to a radially oriented outer end face 60 of the scavenging opening 18 by means of bolts 64, 64, which form second fitting members. A first engagement groove 66 extending radially inwardly from a radially oriented outer edge 22*e* is formed in an upper face of the passage upper wall portion 22 of each of the scavenging blocks 20A.

Figure 11:
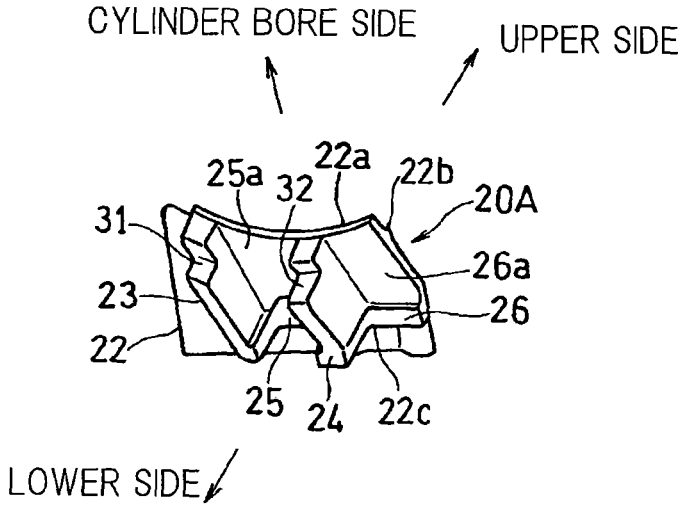
FIG. 11 is a perspective view of the scavenging block of the two-stroke cycle combustion engine as viewed from inwardly below.

As shown in FIG. 11 showing a perspective view as viewed from below, the scavenging block 20A is of the substantially same shape as that employed in the practice of the second embodiment of the present invention and is of one piece construction formed by the use of a mold assembly such as, for example, casting so as to include a radially extending passage upper wall portion 22, first and second partition wall portions 23 and 24 extending respectively downwardly from an inner half portion 22*c* ranging from the radially oriented inner end 22*a*, spaced from the covering member 21 (FIG. 10) in the passage upper wall portion 22, towards the intermediate portion, and first and second guide wall portions 25 and 26 extending downwardly from a lower surface of the passage upper wall portion 22 and continued respectively to upper side faces of the first and second partition wall portions 23 and 24. The first and second guide wall portions 25 and 26 have a vertically measured length that is smaller than the height of the first and second partition wall portions 23 and 24 and have respective guide faces 25*a* and 26*a* diagonally upwardly inclined from lower end portions of them towards tip ends (inner ends) thereof. Also, a first stepped portion 22*b* is formed in the vicinity of a tip end portion of the passage upper wall portion 22 of each of the scavenging blocks 20A, that is, the radially inner end 22*a*.

Figure 12:
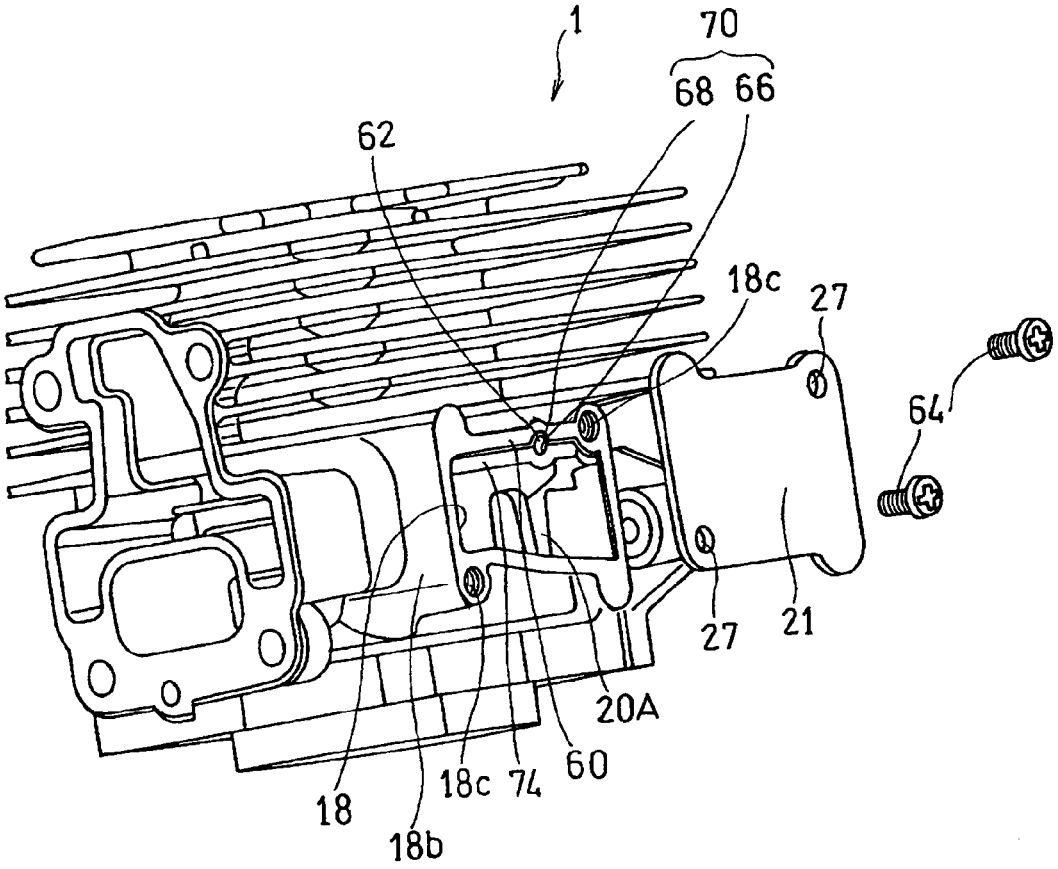
FIG. 12 is an exploded perspective view showing the scavenging block mounted on the cylinder block of the two-stroke cycle combustion engine.

As shown in FIG. 12, a second engagement groove 68 is formed at a location corresponding to the first engagement groove 66 in the opening upper face forming a part of the inner peripheral surface of each of the scavenging openings 18 in the cylinder block 1, and when the respective scavenging block 20A is mounted inside the associated scavenging opening 18 in the cylinder block 1, an engagement hole 70 of a round sectioned shape is formed by those first and second engagement grooves 66, 68. The scavenging block 20A is fitted inside the associated scavenging opening 18 in the cylinder block 1 with the spring pin 62 pressed into that engagement hole 70. At this time, the respective scavenging block 20A is received within the scavenging opening 18 in a condition with almost no gap formed between it and the inner peripheral face of the scavenging opening 18 and is therefore accurately positioned with respect to the circumferential and axial direction of the cylinder block 1. Thereafter, in a condition with an inner surface 21*a* (FIG. 10) of the covering member 21 held in contact with the end face 60 of the scavenging opening 18, the bolts 64, 64 are passed through the respective mounting holes 27, 27 in the covering member 21 and then threaded into the corresponding screw holes 18*c*, 18*c* defined in the opening peripheral wall 18*b* of the scavenging opening 18 to thereby secure the covering member 21 to the cylinder block 1. A radially oriented outer end face 74 of each of the scavenging blocks 20A is positioned at a location somewhat radially inwardly of the radially oriented outer end face 60 of the scavenging opening 18 and, therefore, a gap is formed between it and the inner face 21*a* (FIG. 10) in the covering member 21.

Although in this embodiment, reference has been made to the use of the spring pin 62 as the first fitting member, each of the scavenging blocks 20A may be fitted to the respective scavenging opening 18 in the cylinder block 1 by the use of a bonding agent or by means of spot welding. Also, each scavenging block 20A can be fitted inside the associated scavenging opening 18 when screw holes are formed in the covering member 21 and, on the other hand, respective screw members are threaded into those screw holes so that free ends of the screw members can be brought into abutment with the radially outwardly oriented end face (outer side face) of the respective scavenging block 20A to press the latter.

According to the third embodiment described hereinabove, since each of the scavenging blocks 20A and the associated covering member 21 are prepared using the members separate from each other, the freedom of choice in, for example, shape and manufacturing method of the respective scavenging block 20A can be increased.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

1 . . . Cylinder block
1*a* . . . Combustion chamber
1*b* . . . Second stepped portion
2*a* . . . Crank chamber
10 . . . Air passage
13 . . . First scavenging passage
13*a* . . . First scavenging port
13*aa* . . . Scavenging port upper edge portion
14 . . . Second scavenging passage
14*a* . . . Second scavenging port
16 . . . Introducing passage
18 . . . Scavenging opening
18*b* . . . Peripheral wall of the opening
20, 20A . . . Scavenging block
21 . . . Covering member
22 . . . Passage upper wall portion
(Upper portion of the scavenging passage)
22*b* . . . First stepped portion
23 . . . First partition wall portion
(Passage wall which is a part of the introducing passage)
24 . . . Second partition wall portion
(Passage wall which is a part of the introducing passage)
25 . . . First guide wall portion
26 . . . Second guide wall portion
25*a*, 26*a* . . . Guide face
31 . . . Introducing hole
A . . . Air
M . . . Air/fuel mixture

What is claimed is:

1. A two-stroke cycle combustion engine of an air scavenging type which comprises:

one or more scavenging passages for communicating a crank chamber and a combustion chamber;

an air passage for supplying air;

an introducing passage for introducing the air from the air passage into an upper portion of each scavenging passage from a direction radially outwardly of a cylinder block to provide scavenging air to each scavenging passage;

a covering member for covering the introducing passage from an outer side; and a scavenging block connected to the cylinder block and forming the upper portion of each scavenging passage and a part of the introducing passage, the introducing passage being formed between the scavenging block and the covering member, wherein a first scavenging passage supplies air and an air/fuel mixture from within the crank chamber to the combustion chamber in which a radially outer side portion of a passage wall, forming the first scavenging passage, is formed with an introducing hole through which the air within the introducing passage is introduced, and a second scavenging passage for supplying mainly air from the introducing passage to the combustion chamber, and in which the introducing passage is communicated with the second scavenging passage through a radially outer side of the first scavenging passage, and wherein the scavenging block is formed integrally with a passage upper wall portion extending in a radial direction, and first and second partition wall portions extending downwardly from an inner side half of the passage upper wall portion occupying a region from a radially inner end portion of the passage upper wall portion to an intermediate portion thereof; and an upper portion of the first scavenging passage is formed between the first partition wall portion and the second wall portion and an upper portion of the second scavenging passage is formed between the second partition wall portion and the cylinder block.

2. The two-stroke cycle combustion engine of the air scavenging type as claimed in claim 1, in which:

an upper edge of the scavenging port opening towards the combustion chamber is formed by a scavenging port upper edge portion in a peripheral wall of the cylinder block; and a radially inner end of the upper portion of the scavenging block is positioned at a location radially outwardly of the scavenging port upper edge portion.

3. The two-stroke cycle combustion engine of the air scavenging type as claimed in claim 1, in which the scavenging block is received within a scavenging opening defined in a peripheral wall of the cylinder block so as to extend completely through a portion of such opening peripheral wall, and in which the covering member is fitted to a radially oriented outer end face of the scavenging opening.

4. The two-stroke cycle combustion engine of the air scavenging type as claimed in claim 1, further comprising first and second guide wall portions formed integrally with the scavenging block so as to extend downwardly from a lower surface of the passage upper wall portion and continued to respective upper side faces of the first partition wall portion and the second partition wall portion, and in which the first and second guide wall portions have a length as measured in a vertical direction, which is smaller than the respective heights of the first and second partition wall portions and also have respective guide faces inclined diagonally upwardly from corresponding lower end portions towards inner ends.

5. The two-stroke cycle combustion engine of the air scavenging type as claimed in claim 1, in which the scavenging block is connected with a scavenging opening in the cylinder block; an upstream portion of the introducing passage is formed between a peripheral wall of the scavenging opening and the first partition wall portion; and a downstream portion of the introducing passage is formed below an outer half of the passage upper wall portion ranging from sites aligned with radially outer ends of the first and second partition wall portions in the passage upper wall portion to a radially outer end of the passage upper wall.

6. The two-stroke cycle combustion engine of the air scavenging type as claimed in claim 1, in which a first stepped portion is formed in a front end region of a passage upper wall portion in the scavenging block so as to protrude upwardly, and a second stepped portion depressed upwardly to allow the first stepped portion to contact therewith is formed in a radially outer portion of an upper edge of the scavenging port open towards the combustion chamber in the cylinder block.

7. A two-stroke cycle combustion engine of an air scavenging type which comprises:

a plurality of scavenging passages for communicating a crank chamber and a combustion chamber;

a plurality of air passages for supplying air;

a plurality of introducing passages for respectively introducing the air from one of the plurality of air passage into an upper portion of each scavenging passage from a direction radially outwardly of a cylinder block to provide scavenging air to the scavenging passage for introduction into the combustion chamber;

a pair of covering members, each forming a portion of one of the plurality of introducing passages from an outer side; and a pair of scavenging blocks connected to the cylinder block, each scavenging block forming an upper portion of one of the plurality of scavenging passages and a part of one of the plurality of introducing passages, the introducing passage being formed between the scavenging block and the covering member, wherein in each scavenging block a first scavenging passage supplies initially scavenging air and subsequently both air and an air/fuel mixture, from within the crank chamber, to the combustion chamber in which a radially outer side portion of a passage wall, forming the first scavenging passage, is formed with an introducing hole through which the air within the introducing passage is introduced, and wherein a second scavenging passage supplies mainly air from the introducing passage to the combustion chamber for scavenging, and the introducing passage is communicated with the second scavenging passage through a radially outer side of the first scavenging passage, wherein each of the pair of scavenging blocks is formed integrally with a passage upper wall portion extending in a radial direction, and first and second partition wall portions extending downwardly from an inner side half of the passage upper wall portion occupying a region from a radially inner end portion of the passage upper wall portion to an intermediate portion thereof; and an upper portion of the first scavenging passage is formed between the first partition wall portion and the second partition wall portion and an upper portion of the second scavenging passage is formed between the second partition wall portion and the cylinder block.

8. The two-stroke cycle combustion engine of the air scavenging type as claimed in claim 7, in which:

an upper edge of a scavenging port opening towards the combustion chamber is formed by an upper edge portion in a peripheral wall of the cylinder block; and a radially inner end of the upper edge portion of the scavenging block is positioned at a location radially outwardly of the scavenging port upper edge portion.

9. The two-stroke cycle combustion engine of the air scavenging type as claimed in claim 7, in which each of the pair of scavenging blocks is received within a scavenging opening defined in a peripheral wall of the cylinder block so as to extend completely through a portion of such opening peripheral wall, and in which the covering member is fitted to a radially oriented outer end face of the scavenging opening.

10. The two-stroke cycle combustion engine of the air scavenging type as claimed in claim 7, in which each of the pair of scavenging blocks is received within a scavenging opening defined in a peripheral wall of the cylinder block so as to extend completely through a portion of such opening peripheral wall, and in which the covering member is fitted to a radially oriented outer end face of the scavenging opening.

* * * * *